US006964116B2

(12) United States Patent
Kroll et al.

(10) Patent No.: US 6,964,116 B2
(45) Date of Patent: Nov. 15, 2005

(54) AMBULATORY HAIRDRYER

(76) Inventors: Mollie B. Kroll, 155 West Third St. #203, Tempe, AZ (US) 85281; Mark W. Kroll, 493 Sinaloa Rd., Simi Valley, CA (US) 93065

( * ) Notice: Subject to any disclaimer, the term of this patent is extended or adjusted under 35 U.S.C. 154(b) by 0 days.

(21) Appl. No.: 10/307,881

(22) Filed: Dec. 2, 2002

(65) Prior Publication Data

US 2004/0103553 A1 Jun. 3, 2004

(51) Int. Cl.[7] ..... A45D 00/00
(52) U.S. Cl. ..... 34/96; 34/99; 2/174
(58) Field of Search ..... 34/96, 97, 98, 34/99, 100, 101; 392/379, 380; 2/174, 171.3

(56) References Cited

U.S. PATENT DOCUMENTS 3,108,862 A * 10/1963 Toulmin ..... 34/99
3,727,321 A * 4/1973 Waters et al. ..... 34/99
3,800,431 A * 4/1974 Hubner ..... 34/99
3,813,696 A * 6/1974 Yeager ..... 2/171.3
3,822,698 A * 7/1974 Guy ..... 128/201.25
3,946,498 A * 3/1976 Waters et al. ..... 34/99
4,038,759 A * 8/1977 Dyer et al. ..... 34/99
4,384,411 A * 5/1983 Stiegler et al. ..... 34/99
4,493,975 A * 1/1985 Yamamoto ..... 219/370
5,195,253 A 3/1993 Poumey et al.
5,289,695 A * 3/1994 Parrish et al. ..... 62/259.3
5,647,007 A * 7/1997 Wooderson et al. ..... 381/332
5,651,190 A 7/1997 Sanders
5,787,601 A 8/1998 Stelly
5,810,467 A * 9/1998 Hurwitz ..... 362/106
5,857,262 A 1/1999 Bonnema et al.
5,940,980 A 8/1999 Lee et al.
6,038,783 A * 3/2000 McFadden ..... 34/99
6,058,944 A 5/2000 Porter
6,110,533 A 8/2000 Coté et al.
6,157,298 A * 12/2000 Garfinkel et al. ..... 340/479

* cited by examiner

*Primary Examiner*—Henry Bennett
*Assistant Examiner*—Camtu Nguyen

(57) ABSTRACT

A portable self-contained hair drying helmet is taught that has thermal storage, desiccants, and thin lithium ion polymer batteries to allow one to dry their hair while walking around and performing personal and household duties.

7 Claims, 8 Drawing Sheets

HAIR DRYING METHOD

RECOVERY METHOD

AMBULATORY HAIRDRYER

BACKGROUND OF THE INVENTION

Many people spend a half an hour in the morning to dry their hair. This is non-productive time, which must be spent with a hairdryer in one hand. Thus there is need for a portable hair dryer that would dry the hair while the person is able to perform other morning duties. Several such devices have been patented already. The portable hairdryer of Waters (U.S. Pat. No. 3,946,498), which is a unit that hangs on the head, which is powered by a long extension cord. The cordless drier of Tomay (U.S. Pat. No. 5,195,253) teaches a handheld blower type dryer with both an electrical and thermal battery. This is also impractical since it requires the full time use of one hand.

The hands-free hair dryer of Sanders (U.S. Pat. No. 5,651,190) teaches a hair bonnet connected by a flexible hose to a battery pack worn on the back. This is not very practical for a number of reasons. The hose would interfere with many activities, and the heavy battery requires a strap to be attached to the body. And lastly the battery's longevity is very limited. Consider the worst-case example and assume that one needs to have the dryer at 1500 watts for 30 minutes. This equates to a total energy use of 2.7 mega joules. If this was powered by a 12 volt battery this would require a total charge of 225 coulombs. This is equivalent to 62.5 ampere hours, which is the capacity of a large conventional car battery.

Thus the battery-operated devices have not proven practical. Similarly the portable hair dryer of Stelly (U.S. Pat. No. 5,787,601) with a rechargeable battery pack has not proven practical.

The portable hair dryer of Bonnema (U.S. Pat. No. 5,857,262) is a gas-powered drier. While this will presumably store enough energy for a full cycle of drying as hydrocarbons are highly efficient energy storage units, this would still require the use of a hand to hold and control the dryer.

The hands-free dryer of Lee et. al. (U.S. Pat. No. 5,940,980) is essentially a conventional hand-held drier attached to a gooseneck tubing, which is attached to a large clip for attachment to convenient furniture or fixtures. This again is not very practical as it requires total focus on position of the head with respect to the dryer.

Finally the portable dryer of Porter (U.S. Pat. No. 6,058,944) teaches a bonnet and hose with a purse style hydrocarbon heater feeding the hot, dry air to the hose. This has some of the same limitations as some of the early devices in that it would require the carrying of the heater unit and the hose would be interfering with natural movements. In addition, the propane reservoir in the purse unit would have to be recharged on a regular basis.

Thus, in spite of the demonstrated need for a truly portable hair dryer no practical unit has been brought to the market.

SUMMARY OF THE INVENTION

The invention is a hair-drying helmet that is completely portable and ambulatory. The hair-drying helmet contains a built in battery to power a fan. It is another significant feature of this invention that the helmet has desiccant materials on the inside for passive drying of the hair. It is another significant feature of the invention that the helmet is made of a very high heat capacity polymer. It is another significant feature of this invention that the whole system of the helmet can be simply automatically regenerated by setting it on a stand, which is in turn powered from household energy sources.

DETAILED DESCRIPTION OF THE DRAWINGS

Figure 1:
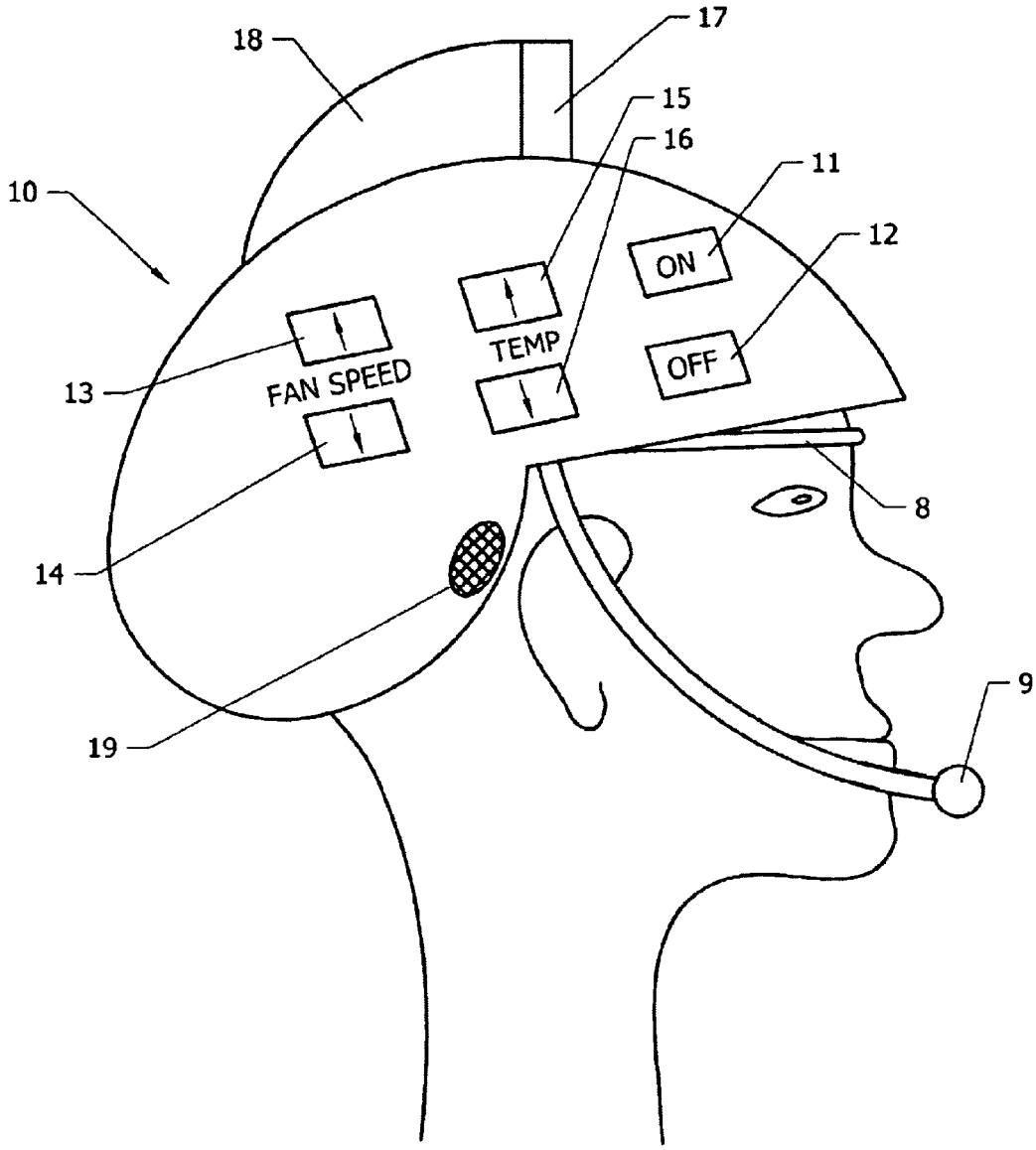
FIG. 1 shows a basic hair-drying helmet on the head of a user.

FIG. 1 shows the helmet 10 and use of the head of the user. Brow strap 8 holds it on the head. Microphone boom 9 allows for the user to answer telephone calls during the drying operation. On switch 11 and off switch 12 are used to turn the device on and off. Fan speed switches 13 and 14 are used to accelerate and decelerate the fan respectively. Temperature increase switch 15 and decrease switch 16 are used to adjust the temperature in the helmet.

Fan 17 is used to force air in from the outside and direct it down through channel 18 on to the head of the user.

A suitable fan is the MDS series DC axial flow fans from Oriental Motor USA Corp located at OrientalMotor.com. The smallest frame size at 1.65 square inches for input voltage of 12 VDC is appropriate for the design.

Also shown is the optional small speaker 19 to allow the user to listen to the radio through direct FM reception. Alternatively this could be used for producing noise cancellation over the user's ear or with a Bluetooth connection to listen to the television or the user's stereo system. This speaker is also used in conjunction with the microphone 9 for telephone operation.

Figure 2:
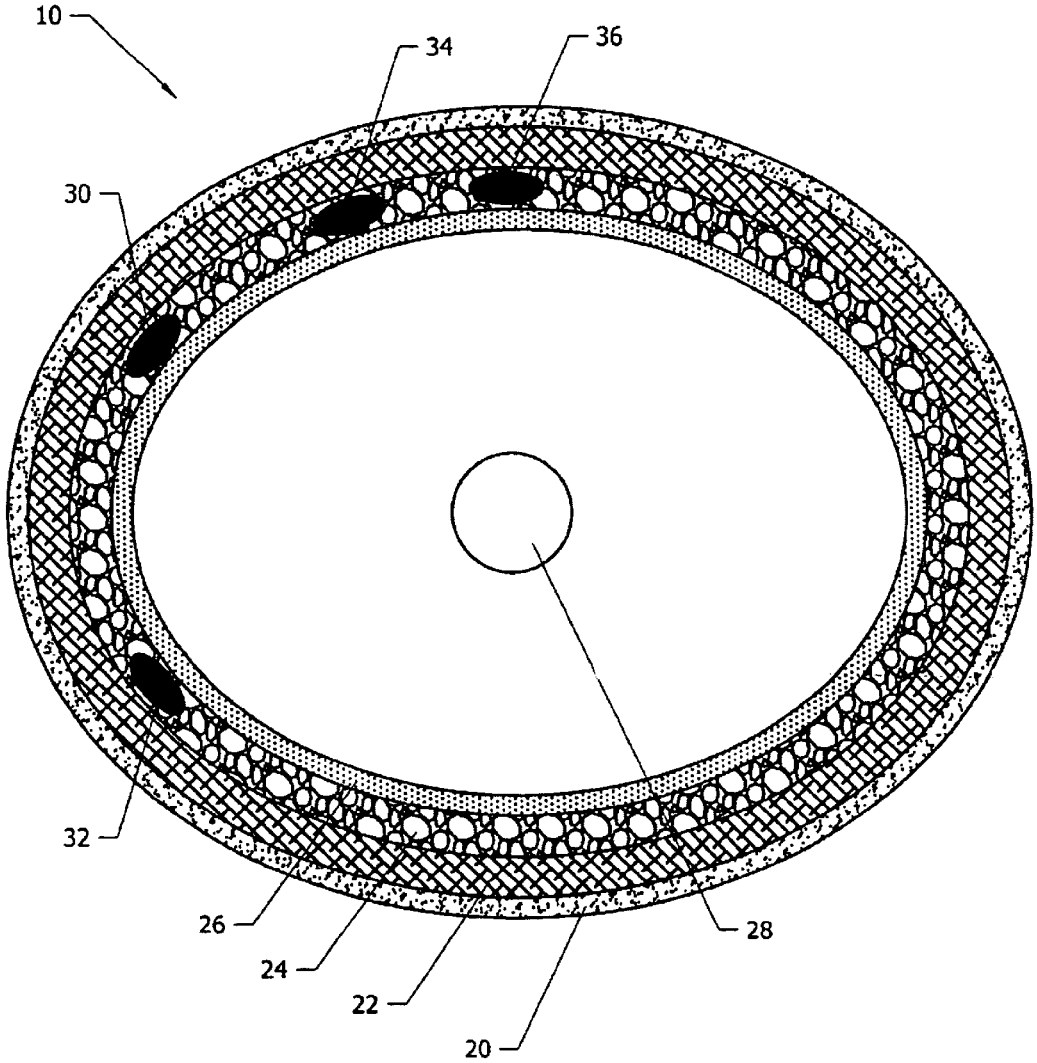
FIG. 2 shows a schematic bottom view of the helmet.

FIG. 2 shows a bottom view of the helmet 10. On the outside is a thin layer of thermal insulation 20. This could be any suitable plastic with a low thermal conductivity such as Dow Chemical company Styrofoam. Alternatively the outer layer is applied with a "soft-touch" overmolding process. Preferentially the oft touch overmolded material is polyetheramide, polyetherester, polyesterester, or styrene ethylbutylene styrene. Just inside of that is the layer of a thermal storage plastic 22. A preferable plastic is nylon six. Nylon six has the remarkable property of having almost the same heat capacity as water. This heat capacity is about 3.9 J/g° C. While assuming for purposes of this illustration, that the layer of nylon six is 4 mm thick and that the average radius of the helmet is 10 cm then the area of the half-shell helmet would be approximately 628 $cm^2$. Multiplying this by a 4 mm thickness gives an approximate volume of 251 ml. The density of nylon six is about 1.09 g/ml giving a total approximate mass of 274 g. The heat storage in the nylon six then going from a preheated temperature 60° C. down to 30° C. (which is comfortable to the human head) would be 274 g×3.9 J/g° C.=32 kJ. Suitable suppliers for nylon six include Allied Signal which sells nylon six under the trade name Capron® or Prima Plastics which sells nylon six under the trade name Primapron® or Bayer Corporation Plastics Divisions which sells nylon six under the trade name Durethan®.

Assuming a blonde with long hair (blondes have the most hair, approximately 140,000 hairs on the head) the mass of wet hair would be approximately 100 g. The energy stored in nylon six on its own would be sufficient to raise the temperature of the wet hair by almost 80° C. Because of the limited temperature of the preheated nylon six (to prevent burning) this would not be done alone but would rather be assisted by the heating elements.

The next layer 24 is a lithium polymer battery. Which battery has been announced by Caleb Technology Corporation located at Caleb-Battery.com. The battery is available in very thin sheets and can be wrapped inside and bonded to the helmet and is also rechargeable. The capacity is greater than 60 Ah/kg with an average lithium ion voltage of 3.8 V. The cycle life is over 1,000 charged cycles with an operating temperature range of up to 60° C. In fact, the lithium ion polymer batteries have excessive internal impedance at room temperature for many uses. They perform much better at 60° C. because the internal impedance is lowered significantly. Hence, the advantage of having the lithium ion polymer battery bonded directly to the nylon six heat source. With a 1 kg of total battery built into the helmet the device would store 60 Ah×3.8 V=820,800 J. This would allow the continuous delivery of 456 watts=820,800 J/30 minutes/60 seconds per minute for the typical half hour drying cycle. While this is not enough to power a full 1500 watt conventional blow dryer—due to the high efficiency design of the helmet it would be more than enough to completely dry the operator's head.

The next layer the desiccant 26. This desiccant would be preferentially a mixture of silica gel and molecular sieve zeolite (sodium aluminal silicate). The advantage of the zeolite is it will hold 20% of its weight in moisture down to very low relative humidity. The advantage of the silica gel is that it will hold about 45% of its weight, but that drops down very quickly as the relative humidity goes to zero. Thus the preferred embodiment entails a combination of the two desiccants.

A suitable source for both desiccants is the Polylam Corporation located at polylam.com.

An alternative sophisticated desiccant is a cross linked polymeric desiccant such as that taught by Coté in U.S. Pat. No. 6,110,533 which is incorporated herein by reference.

The helmet top air port 28 as shown in the center of FIG. 2.

Electrode contacts 30 and 32 are located on the bottom of the helmet for recharging the battery. Electrode contacts 34 and 36 are also located in the bottom of the helmet to allow for the contact to the capacitive humidity sensor, which is located in the base. Contacts 34 and 36 respectively mate with base contacts 52 and 53 shown in FIG. 3.

Only 500 grams of zeolite could absorb all of the 100 g of water in the wet hair. Due to the fact that half of the humidity will be dissipated in the exhaust air the desiccants really only need to store about 50 g of water. This would be divided between the zeolite and the silica gel so that the required mass of desiccant would be about 200 g.

Figure 3:
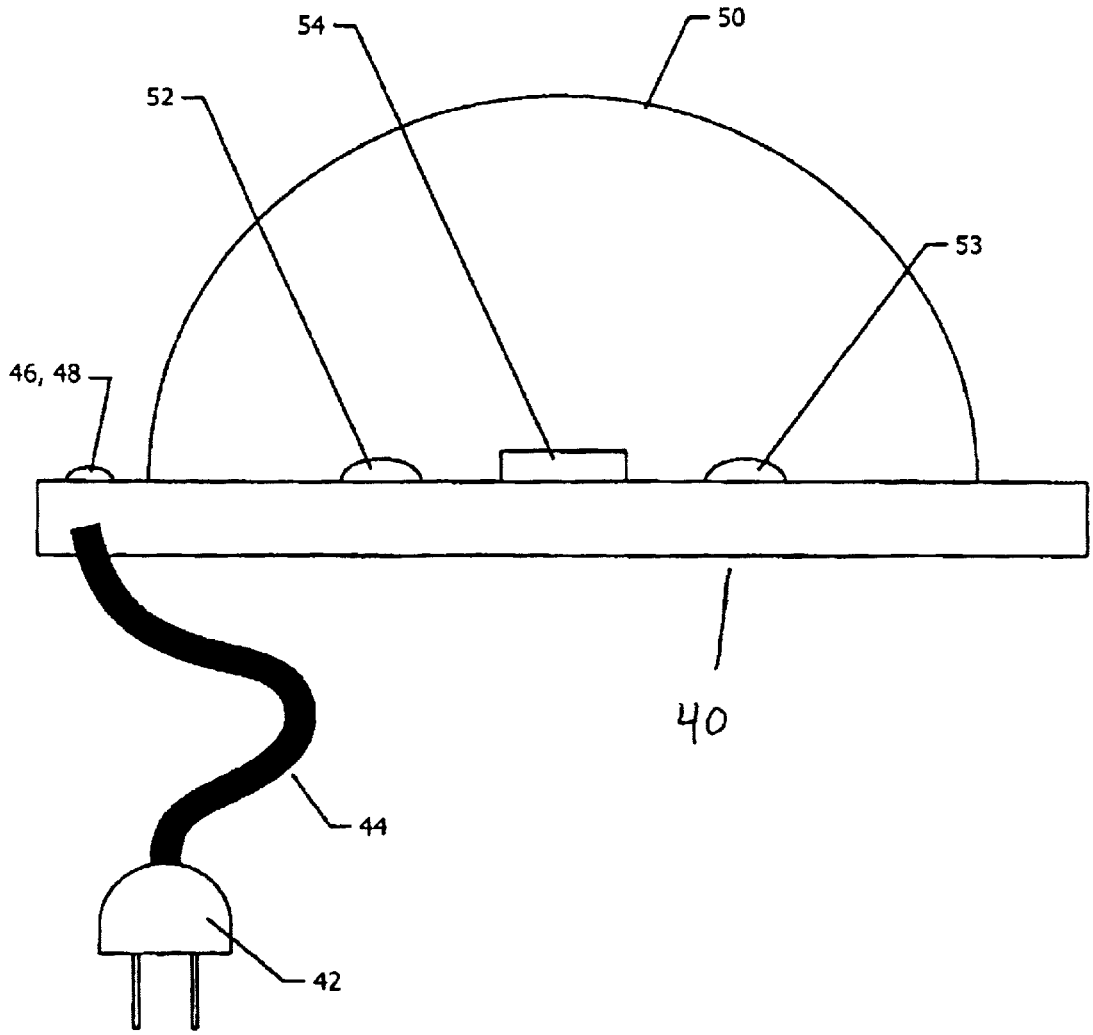
FIG. 3 shows a side view of the regenerating base station.

FIG. 3 shows the side view of the base regeneration station 40. Power cord plug 42 is plugged into the household electrical supply and provides current through cord 44 to the base unit 40. Pressure contacts 46 and 48 are designed to mate with contacts 30 and 32 on the helmet. Contacts 52 and 53 are connected to the capacitance humidity sensor 54. This allows the circuitry in the helmet to read the local air humidity during a regeneration phase. The dome 50 in the middle of base station 40 performs two functions. First it forces an accurate centering of the helmet so that the electrode contacts are aligned properly. Secondly, it forces the airflow to go through the sides of the helmet so as to recycle the desiccant.

Figure 4:
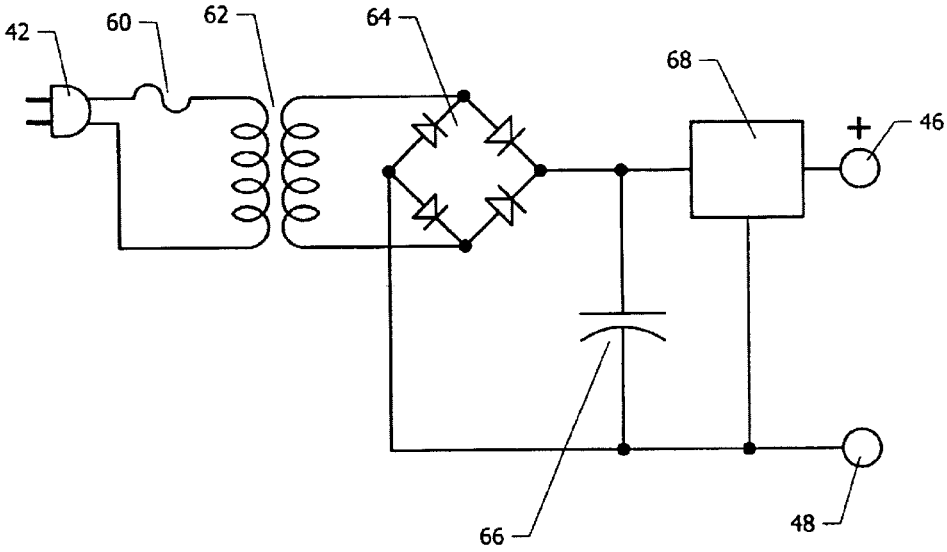
FIG. 4 shows the electronic schematic of the base station.

FIG. 4 shows the schematic for the power supply for the base unit. Power plug 42 feeds power into the unit, which is limited by fuse 60 and thence to transformer 62 to reduce the voltage to approximate 12 VAC RMS. This is fully rectified by rectifier bridge 64 and then filtered by filter capacitor 66. Finally that rectified DC power is voltage and current limited by power supply controller 68 to provide a positive 12 volts to terminal 46 with a return at terminal 48.

Figure 5:
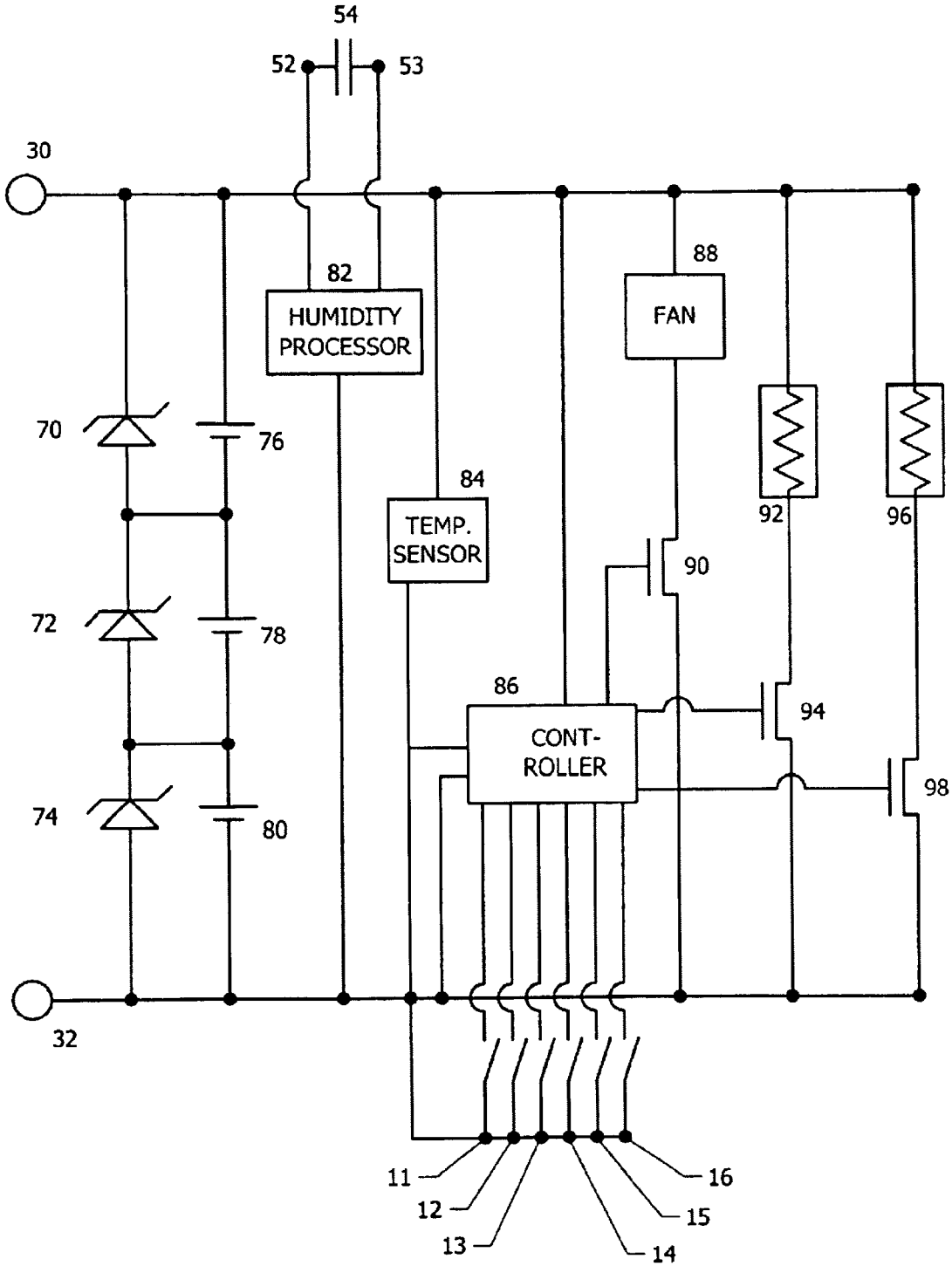
FIG. 5 shows the electronic schematic for the helmet.

FIG. 5 teaches the basic schematic of the helmet. The power is input on terminals 30 and 32 from the base station for recharging. This is then used to recharge the three battery sections in series namely lithium ion polymer cells 76, 78 and 80. Each of these is protected from overcharging by Zener diode 70, 72, and 74 respectively.

Controller 86 performs all sensor data processing and system controls. As previously mentioned the capacitance humidity sensor 54 is located at the bottom of the base unit in the top of the airflow from the helmet being regenerated. This type of sensor is most simply explained by the fact that a thin electric polymer layer absorbs water molecules through the very thin metal electrode and causes a capacitance change proportional to the relative humidity due to the fact that its dielectric constant changes. A device using this technology is available from Met One Instruments of Grants Pass, Oreg. or NovaLynx Corporation at novalynx.com. Suitable capacitance based humidity sensors are the APS-200 from General Eastern Instruments of Woburn, Mass. (www.geinet.com). Thus the capacitance humidity sensor will be able to sense the humidity of the air coming down from the helmet so the system will "know" when the helmet has been dried out. This capacitance value then goes into humidity processor 82 where it is converted to a DC level to be fed to the controller 86.

The temperature sensor 84 is mounted inside the nylon six main body. This feeds a DC voltage proportional to the temperature into the controller 86. A suitable temperature sensor is the REF 02 available from Maxim at Maxim-IC.com.

Alternatively both the humidity sensing function and the temperature sensing function may be performed by a single integrated sensor. The preferred sensor is the SHT11 from Sensirion AG of Zurich Switzerland and located at www.sensition.com.

Switches 11, 12, 13, 14, 15, and 16 control the fan speed up or down, the temperature up or down, and the on/off functions as described in FIG. 1.

Fan 88 is controlled by power MOSFET 90, which is in turn controlled by the controller 86. Nichrome heating wires 92 are controlled by power MOSFET 94, which is in turn controlled by the controller 86. Optional heating wires 96 in the air stream of the fan on top of the helmet are controlled by power MOSFET 98, which is in turn controlled by the controller 86. A suitable choice for the power MOSFETs 90, 94, and 98 is the IRF6601 from International Rectifier located at IRF.com.

Figure 6:
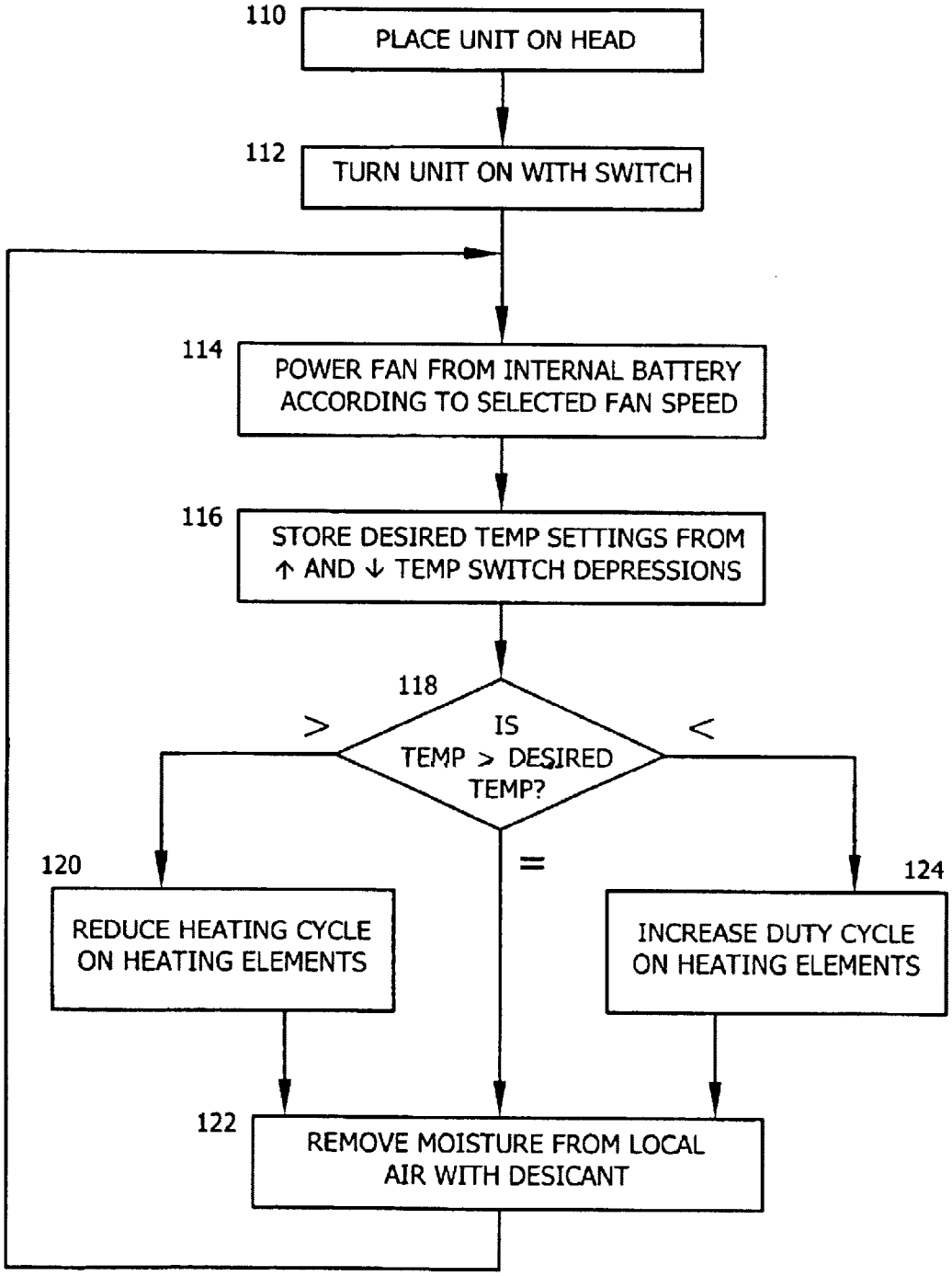
FIG. 6 shows the method for drying hair taught in this invention.

The hair drying method is explained in FIG. 6. At step 110 the operator places the helmet on the head and then turns the unit on with the switch in step 112. At step 114 the fan is powered from the internal battery according to the selected fan speed. In step 116 the controller stores the desired temperature settings from the "up" and "down" temperature switch depressions. At step 118 the controller asks if the temperature is greater than the desired temperature. If it is in fact greater than the desired temperature then the method branches to step 120 to reduce the duty cycle on the heating elements by giving shorter on pulses to MOSFETs 94 and 98. If the temperature is approximately equal to the desired temperature then the system progresses down to step 122, which is to remove the moisture from the local air with the desiccant. This is also where the method ends up after completing step 120. If the temperature is in fact less than the desired temperature then the system will increase the duty cycle on the heating elements in step 124.

Figure 7:
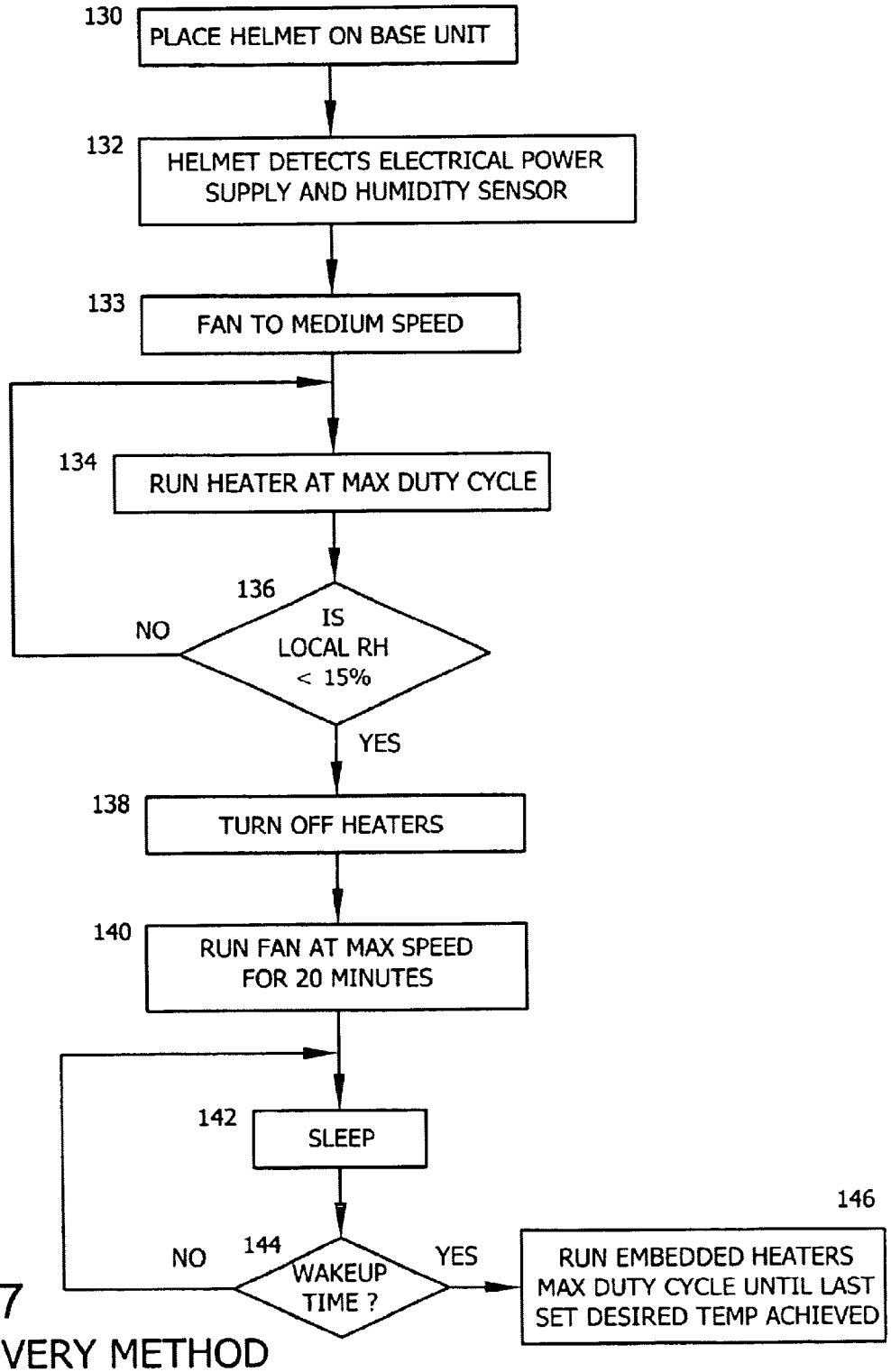
FIG. 7 shows the method for the regeneration and recovery of this invention.

FIG. 7 explains the recovery and regeneration method of the invention. In step 130 the operator places the helmet on the base unit. In step 132 the helmet detects the electrical power supply connections and the humidity sensor connections. In step 133 the system runs the fan to a medium speed. In step 134 the system runs the heater at a maximum duty cycle. The system then goes to the branch question 136 and asks if the local relative humidity is less than 15%. If it is not then the system continues to cycle through step 134.

If in fact the local relative humidity is finally brought down below 15% then we can be confident that the desiccants have dried out. At this point the method progresses to step 138 where the heaters are turned off. The method then goes to step 140 where the fan is run at maximum speed for 20 minutes.

This is because the desiccant recycling is actually a 2-step process. To begin with, dry desiccant has a low vapor pressure and the moist air coming off of the wet hair has a higher vapor pressure. Therefore the water vapor moves from the air to the desiccant to equal that pressure difference during the drying operation. As the desiccant collects water its vapor pressure and temperature rise until the vapor pressure of air and desiccant and the desiccant no longer attract water vapor. At this point the desiccant is said to be in equilibrium. Now, during the regeneration process the desiccant must be dried by heating. Heating raises the vapor pressure at the surface of the desiccant very high. This is well above the vapor pressure and the surrounding air. This is especially true because the dry dome is now replacing the wet human head. So the water moves out of the desiccant towards a lower vapor pressure in the dry air being forced over it now during the regeneration process. Now, even though the desiccant is dry its surface vapor pressure remains high because it is hot. To restore its lower vapor pressure the desiccant must be cooled. This is the point of running the fan at maximum speed as described in step 140.

At step 142 the system goes to sleep for 23 hours. At step 144 the system asks if it is wakeup time. If it is then in step 146 it runs the embedded heaters at maximum duty cycle until the set desired temperature is achieved.

The system is now ready to be used when the operator comes in to take it off of the regeneration base.

Figure 8:
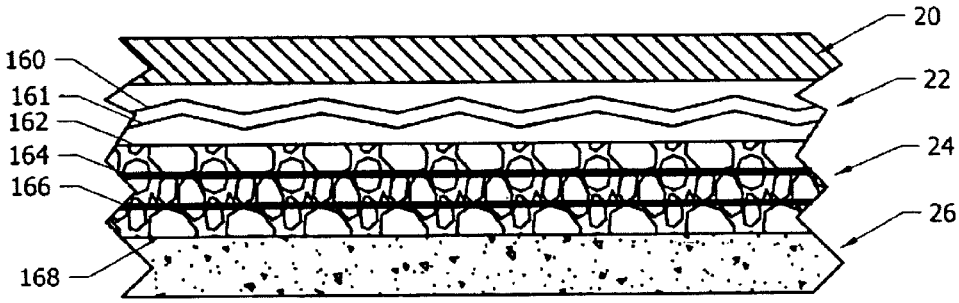
FIG. 8 shows a detailed cross section of the helmet shell.

FIG. 8 shows a detailed cross section of the shell of the helmet. Beginning on the outside is the layer 20 of thermal insulating material. Layer 22 is the nylon six as described below. However here we see the detail of two heating wires, 160 and 161 embedded in the nylon six plastic. These serve to heat nylon six during regeneration and to maintain its temperature during operation.

Layer 24 is the lithium ion polymer battery. Details of this are the outer shell 162, the anode 164, the cathode 166, and the inner wall 168. Finally the desiccant layer 26 is shown.

We claim:

1. A personal ambulatory hair dryer system comprising:

an approximately head-conforming shell, holding desiccant for removing hair moisture, a self-contained and mechanically attached battery weighing less than 1 kilogram, communicatively connected to, a self-contained fan, where the shell is shaped to be positioned upon, a mating self-contained base unit, with at least one heating coil to heat the base unit in order to pre-heat the ambulatory head-conforming shell and dry the desiccant of the shell, and electrical contacts to recharge the battery in the head-conforming shell unit so that the personal ambulatory hair dryer can force air over a wearer's hair to dry the hair while the wearer is ambulatory and the mating base unit can pre-heat, dry, and electrically recharge the ambulatory shell unit.

2. The personal ambulatory hair dryer of claim 1 in which the desiccant contains zeolite.

3. The personal ambulatory hair dryer of claim 1 in which the desiccant contains silica gel.

4. The personal ambulatory hair dryer of claim 1 in which the approximately head-conforming shell contains nylon 6.

5. The personal ambulatory hair dryer of claim 1 in which the self-contained battery is a lithium ion battery.

6. A personal ambulatory hair dryer consisting of:

an approximately head-conforming shell with a mating base unit for regeneration, said shell holding a self-contained battery, communicatively connected to, a self-contained fan, with a humidity sensor mounted on either the shell or the base unit to read the local humidity to control the drying of the shell during a regeneration cycle so that the personal ambulatory hair dryer can force air over a wearer's hair to dry the hair while the wearer is ambulatory.

7. A personal ambulatory hair dryer consisting of:

an approximately head-conforming shell with a mating base unit for regeneration, said shell holding a self-contained battery, communicatively connected to, a self-contained fan, with a mating base unit with a temperature sensor mounted on either the shell or the base unit to read the local temperature to control the heating of the shell during a regeneration cycle so that the personal ambulatory hair dryer can force air over a wearer's hair to dry the hair while the wearer is ambulatory.

* * * * *